United States Patent [19]

Esterl et al.

[11] Patent Number: 4,540,963

[45] Date of Patent: Sep. 10, 1985

[54] RELAY WITH BRIDGE CONTACT SPRING

[75] Inventors: Robert Esterl, Reinstorf; Josef Weiser, Hohenschaftlarn, both of Fed. Rep. of Germany

[73] Assignee: Siemens Aktiengesellschaft, Berlin & Munich, Fed. Rep. of Germany

[21] Appl. No.: 669,726

[22] Filed: Nov. 8, 1984

Related U.S. Application Data

[63] Continuation of Ser. No. 505,344, Jun. 17, 1983.

[30] Foreign Application Priority Data

Jun. 30, 1982 [DE] Fed. Rep. of Germany ..... 3223468

[51] Int. Cl.[3] ..... H01H 63/02

[52] U.S. Cl. ..... 335/133; 335/187; 335/196

[58] Field of Search ..... 335/125, 127, 128, 129, 335/133, 185, 187, 192, 196, 273

[56] References Cited

U.S. PATENT DOCUMENTS

| | | | |
|---|---|---|---|
| 2,245,230 | 6/1941 | Shaw | 335/296 |
| 2,356,836 | 8/1944 | Ebert | 200/165 |
| 2,532,624 | 12/1950 | Kircher | 335/196 |
| 3,155,790 | 11/1964 | Lemonnier | 335/196 X |
| 3,436,697 | 4/1969 | Snyder | 335/115 |
| 3,864,652 | 2/1975 | Zubaty et al. | 335/194 |
| 4,034,323 | 7/1977 | Homma | 335/133 X |
| 4,254,391 | 3/1981 | Gould | 335/119 |
| 4,344,103 | 8/1982 | Nagamoto et al. | 335/133 X |

FOREIGN PATENT DOCUMENTS

| | | | |
|---|---|---|---|
| 0081164 | 6/1983 | European Pat. Off. | 335/133 |
| 388812 | 9/1921 | Fed. Rep. of Germany | 335/133 |
| 1170041 | 5/1964 | Fed. Rep. of Germany | 335/133 |
| 1175807 | 8/1964 | Fed. Rep. of Germany | 335/133 |
| 1816364 | 7/1970 | Fed. Rep. of Germany | 335/133 |
| 2452305 | 5/1975 | Fed. Rep. of Germany | 335/133 |
| 1356966 | 2/1964 | France | 335/133 |
| 326752 | 12/1957 | Switzerland | 335/133 |
| 329893 | 5/1958 | Switzerland | 335/133 |
| 372754 | 12/1963 | Switzerland | 335/133 |
| 1204755 | 9/1970 | United Kingdom | 335/196 |

*Primary Examiner*—George Harris

*Attorney, Agent, or Firm*—Hill, Van Santen, Steadman & Simpson

[57] ABSTRACT

An electrical relay assembly has a spring action bridge contact for engaging with two counter contact elements. The bridge contact is connected with an armature at one end of a longitudinal first section. The other end of the first section is connected to a linearly directed second section having two contact points facing opposite the counter contact elements. The first section has a lateral width not greater than the distance between the contact points. A lever action of the contact points about two different axes thereby results, as a consequence of which a frictional effect is produced at the contact points. The bridge contact is particularly applicable for the switching of low currents.

13 Claims, 12 Drawing Figures

RELAY WITH BRIDGE CONTACT SPRING

This is a continuation of application Ser. No. 505,344, filed 6,17,1983.

BACKGROUND OF THE INVENTION

The invention relates to an electrical relay with an excitation coil, an armature, and at least two counter contact elements, provided with connection elements, which are adjacently arranged in one plane, in which the counter contact elements are electrically bridged by a bridge contact actuatable by the armature which has a spring action about two different axes.

The utilization of bridge contacts has long been conventional in the case of contactors and heavy current relays. A double contact interruption, which can be achieved with a bridge contact activated by an armature stroke, is of particular advantage in the case of switching high currents. In the known bridge contact constructions the bridge contact is customarily switched by the armature via an actuation slide which engages the bridge approximately in the center between the two contact points. In the case of this central actuation virtually no frictional movement, or rolling movement, in the region of the contact points results. During the switching of high currents this may not be necessary since, in the case of contacts, great contact forces, or switching forces, are in play anyway through which a reliable contact making and a reliable contact separation is assured.

In the case of weak or low-voltage current contact relays, the trend to increasingly smaller models inevitably leads to the contact clearances becoming smaller. However, the switching capability, particularly in the case of inductive loads, is also thus reduced. The application of bridge contacts, in spite of a small armature stroke, could improve switching capability; however, standing in the way of an application of bridge contacts conventional in the case of contactors are the disadvantages that the contact resistances, due to double contact interruption, are comparatively high, particularly if films of foreign material form on the contact surfaces. In the case of purely perpendicular contact actuation without frictional movements and rolling movements, such films of foreign material can not be rubbed off, so that the contact forces which are comparatively small in midget relays no longer suffice for a good contact making.

It is an object of the invention to provide a relay with bridge contacts such that it is suited for the switching of very small currents and exhibit a long life. The relay is practical over a wide load range extending from very small currents to very large currents. In addition, an embodiment of such a relay is to be produced which, pursuant to application of the inventive principles, is constructed very simply and with few parts and can likewise be sealed so as to be liquid-tight in a simple fashion.

SUMMARY OF THE INVENTION

A contact relay is provided with a bridge contact fixed at one end in operative connection with the armature and having two contact points arranged at the free end of the bridge contact disposed opposite the counter contact elements. The bridge contact is formed with a longitudinal first section having a lateral width which corresponds to no more than half the distance between the two contact points. The two contact points are arranged offset on a second linear section relative to the longitudinal axis of the first section such that, upon touching of the counter contacts, a spring lever action about the first section's clamping axis as well as an additional spring lever action about an axis offset to the clamping axis can be obtained.

In the inventive relay, through the design and arrangement of the bridge contact, a thrust-friction-rolling-movement on the contact points is produced which arises through the two generally perpendicular spring lever actions between clamping of the spring on the armature and the counter contact elements. Through this frictional movement films of foreign material, which would otherwise increase the contact resistance, are penetrated through during switching and simultaneously, the foreign particles disposed on the contact surfaces are also rubbed away. During the connection of DC current, uneven locations produced due to the occurring material migration are leveled immediately during occurrence.

In one embodiment the bridge contact is designed in T-formation, whereby it is clamped on the armature with one end of the base leg and bears the contact points, respectively, at the free ends of the cross leg. In another embodiment, the bridge contact spring can possess a longitudinal first leg which is clamped on the armature with one end and which supports at its free end, at least on one side, a second contacts leg via a lateral intermediate bar. The bridge contact can also be designed to be meander-shaped along the first section with lateral cut-outs occurring between the clamping point and the contact points.

The contact-frictional movement intended with the invention is particularly favorable obtained if the clamping first section axis of the bridge contact is laterally offset relative to the armature rotational axis. The counter contact elements may emerge in one plane from a base member and through oppositely angled sections to form contact points which are one over the other in one plane. The bridge contact may be provided with a second section contact element such that a double contact making between the bridge contact and two, parallel-switched counter contact elements can be achieved. The application range of the relay for small and large switching loads is thereby substantially expanded.

A further application of the inventive principle is in the case of a relay in which the coil has its axis is arranged horizontally and the armature is arranged essentially parallel to the coil axis. The bridge contact extends over the entire coil length above the plate shaped armature. In the region of a first coil flange, a terminal lug running perpendicularly to the coil axis is connected to one end of the bridge contact and the other end of the bridge contact, in the region of an opposite second coil flange, is disposed opposite the two counter contact elements which extend perpendicularly to the coil axis at their connection elements on opposed sides of the second coil flange, and which, with their contact-making ends disposed opposite the bridge contact spring, are bent oppositely relative to one another into a common plane. Such a relay can be simply manufactured from a few parts.

With the bridge contact spring above the coil, air paths and leakage paths necessary for high currents can be well-realized. The bridge contact disposed above the coil, prior to the application of a housing cap, is easily accessible from the exterior for the purpose of adjustment. Adjustment of a synchronous contact making on both contact points on the bridge contact can be made by bombardment with laser beams, for example, such as taught in German OS No. 2,918,100.

The plate-shaped armature is mounted with one end on a leg of the coil core, which upwardly bent in U-formation, and connected with the bridge contact via an intermediate insulating part. This insulating part can be formed through extrusion coating or other embedding of the armature. However, it is also possible to connect the armature with the insulating part through plugging. In an expedient embodiment, the insulating part exhibits a flexible leg running parallel to the terminal lug portion of the bridge contact and serves as reset spring for the armature. This flexible leg can be supported against an offset tongue of the bridge contact in the region of the terminal lug. On the opposite end of the insulating part a projecting leg can likewise be provided in order to insulate the armature against the counter contact elements.

In a further embodiment the armature is arranged with the bridge contact within the coil along the coil axis. The bridge contact possesses, at the end face before the second coil flange, a cross leg with which it is disposed opposite the counter contact elements. The bridge contact can be connected with the armature in a suitable manner. In this case, a U-shaped yoke with its center portion outside the coil is so arranged that a yoke leg serves the purpose of bearing the armature and the second yoke leg forms, with the armature, the operating air gap. The bridge contact is anchored in the first coil flange to simultaneously serve as the armature reset spring.

DESCRIPTION OF THE PREFERRED EMBODIMENT

Figure 1:
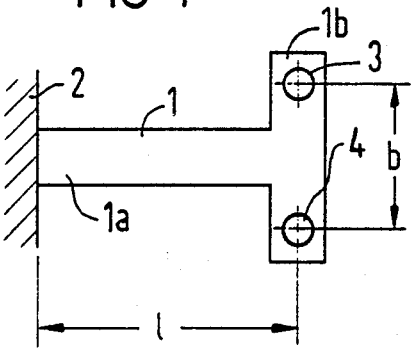
FIG. 1 shows a T-shaped bridge contact unit according to the invention.

FIG. 1 shows a T-shaped bridge contact 1, such as is suitable for an electrical contact relay for the switching of weak or low voltage current. It is clamped in a support 2 at one end of a longitudinally extending first leg 1*a*. The support 2 is fixedly connected with a non-illustrated movable armature. The bridge contact 1 is thus actuated via this support 2 and not via a separate contact slide. A transverse second leg 1*b* possesses at the ends contact points or rivets 3 and 4 which cooperate with respective counter contact elements.

Through this construction and the type of actuation a double spring lever action can be obtained on the bridge contact 1. Acting as lever arm in longitudinal direction is the leg 1*a* having a lever arm length via which a thrust-friction-rolling-movement on the contact points can be obtained. Acting perpendicularly thereto is the cross lever action of the transverse leg 1*b*, in which the lever, in relation to the first leg longitudinal axis, amounts to half the width b between the two contact points 3 and 4. Both levers become effective due to the armature actuation during the contact making and during the contact opening, whereby a friction movement with rubbing and clamping effects are obtained on the contact points.

Figure 2:
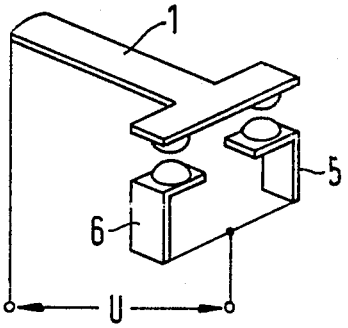
FIGS. 2 through 4 show various electric contact possibilities for the bridge contact unit of the invention.

The bridge contact 1 with an electric connection element renders a relay particularly well-adapted to various switching problems. As, shown in FIG. 2, for example, a double contact making can be obtained, whereby the switching voltage U is applied between the connections of the bridge contact 1, on the one hand, and parallel-connected counter contact elements 5 and 6, on the other hand. Such a double contact making increases switching safety, particularly in the case of switching of small loads.

Figure 3:
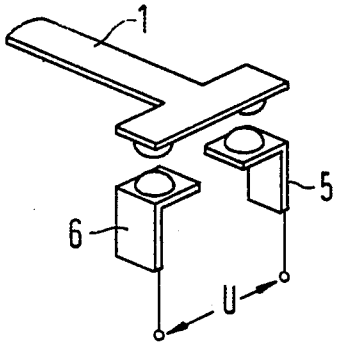

As shown in FIG. 3, a switching voltage U may be connected between the two counter contact elements 5 and 6 so that the bridge contact 1 is merely employed as a contact bridge without a separate connection. In this case double the contact clearance obtainable in the case of a bridge contact is utilized.

Figure 4:
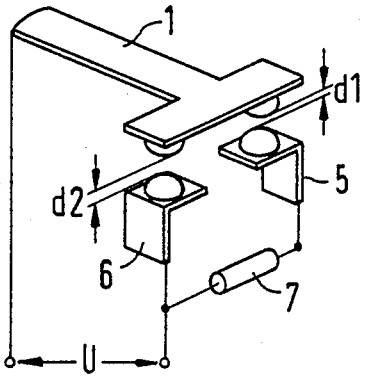

As shown in FIG. 4, a switching voltage U is again connected between the bridge contact 1 and the two counter contact elements 5 and 6. These counter contact elements, however, are not directly parallel-connected; rather, a resistance 7 is connected in series with the counter contact element 5. Moreover, the counter contact element 5 possesses a smaller contact clearance d1 in comparison to the contact clearance d2 of the counter contact element 6 relative to the bridge contact 1. The counter contact element 5 thus serves as a precursor contact which switches earlier. This arrangement can be of advantage in the case of high current peaks.

Figure 5:
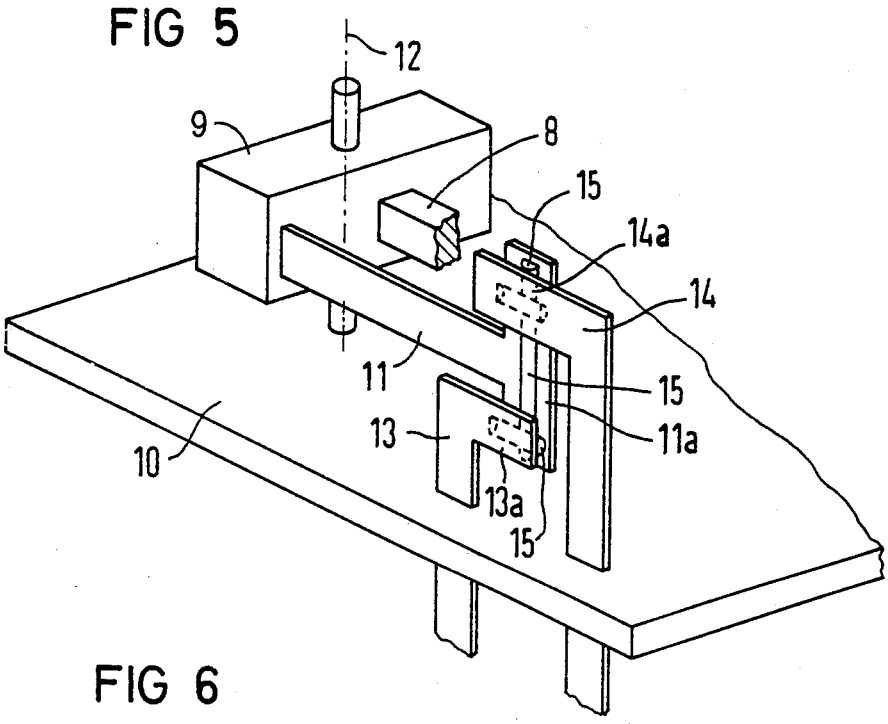
FIGS. 5 and 6 show two various embodiments of bridge contacts connected with an armature.

FIG. 5 schematically illustrates a sample embodiment for the application of the inventive bridge contact assembly in an electrical contact relay with a pivotable armature 8 which is mounted via an insulating support 9 on a base member 10. Connected to the armature 8, via the support 9, is a T-shaped bridge contact comprising a longitudinal portion 11 and a cross piece 11*a*. The longitudinal portion 11 is fixedly clamped in the support 9 and jointly participates in the switching movements of the armature 8 about its rotational axis 12. Two counter contact elements 13 and 14 are anchored in one plane in the base member 10. At their free ends they are respectively bent off at an angle relative to one another such that they form counter contact points 13*a* and 14*a*, respectively, which are disposed above one another in one plane. The counter contacts 13*a* and 14*a* cooperate with the cross piece 11*a* of the bridge contact 11. The contact element profiles 15 are respectively applied over the entire width of the contact-making parts 13*a*, 14*a*, and 11*a*, so that they are disposed in a cross shape above one another and guarantee reliable contact making during the occurring frictional movement.

Figure 6:
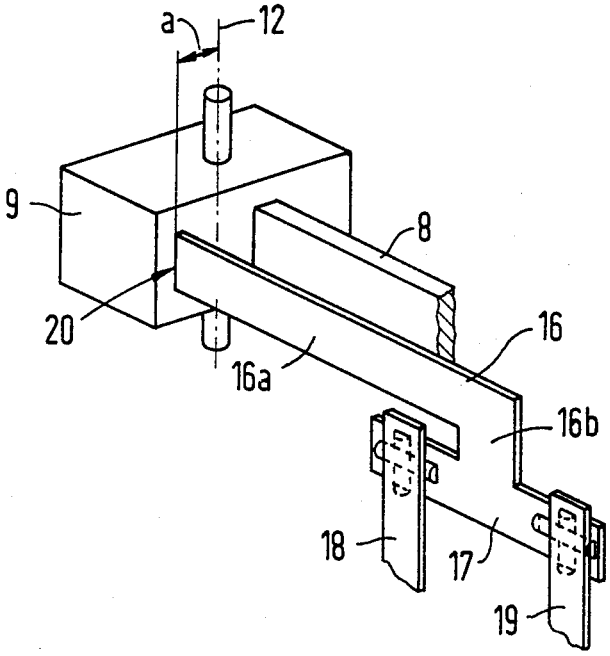

A somewhat modified embodiment of the inventive bridge contact assembly 16 is shown in FIG. 6 in which a longitudinal portion 16*a* is anchored at one end in the support 9. This portion 16*a* supports, at its free end, via a crossbar 16*b*, a contact bridge portion 17 which has a linear axis extending parallel to the longitudinal portion 16*a* and, with its two free ends, respectively, makes contact with two spaced-apart counter contact elements 18 and 19. The double spring lever action of this contact bridge again results about an axis passing through the anchor point 20 as well as relatively about the longitudinal axis of the portion 16*a*.

An intensified frictional movement is provided in the embodiments according to FIGS. 5 and 6 in that the clamping point 20 possesses a relatively large clearance a in relation to the armature rotational axis 12. During switching the bridge contact 16 thereby executes a relatively large movement in its longitudinal direction which results in a corresponding frictional movement on the contact points.

Figure 7:
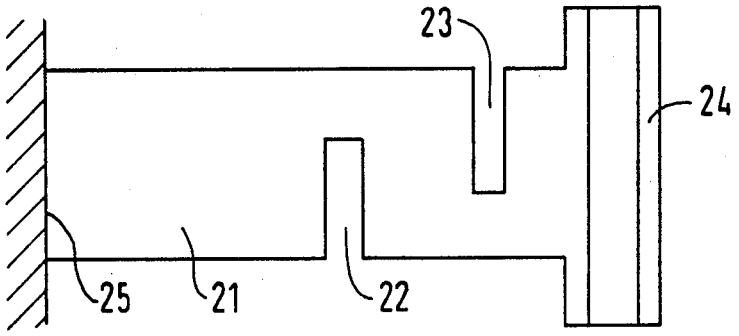
FIGS. 7 and 8 show further embodiments of a bridge contact unit according to the invention.

FIG. 7 shows a further version of the inventive bridge contact assembly having a meander-shaped longitudinal base portion 21, having lateral cut-out spaces 22 and 23. A twice cross-sectional reduction thus occurs between the crosspiece contact bridge 24 and the anchor point 25 preferably to approximately one-third of the spring width to save material.

Figure 8:
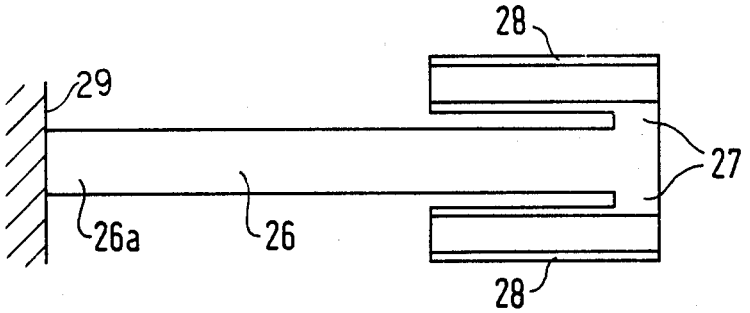

A modified embodiment of the inventive bridge contact 26 is shown in FIG. 8. Therein, at the free end of the longitudinal base portion 26*a*, a pair of contact legs 28 are formed on opposed free ends of a crossbar 27. The individual contact legs 28 together generate, as a contact bridge, the additional spring lever action in relation to the clamping point 29.

Figure 9:
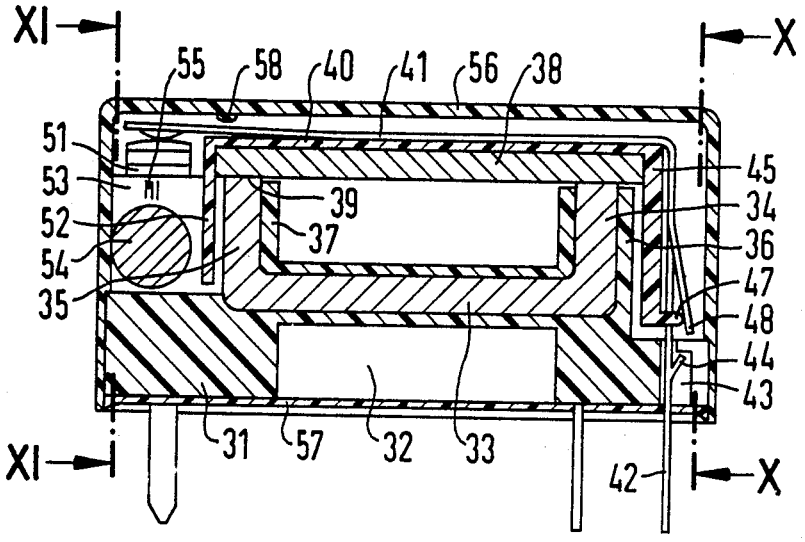
FIGS. 9, 10, and 11 show a relay with a bridge contact in three various views according to the invention.
Figure 10:
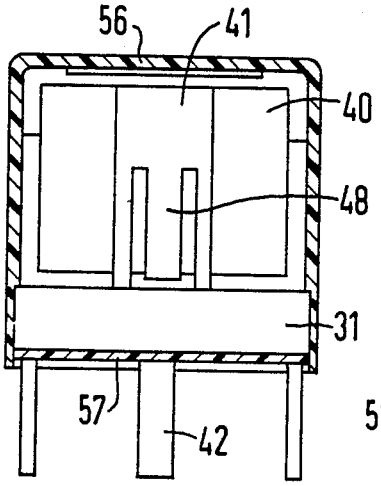
Figure 11:
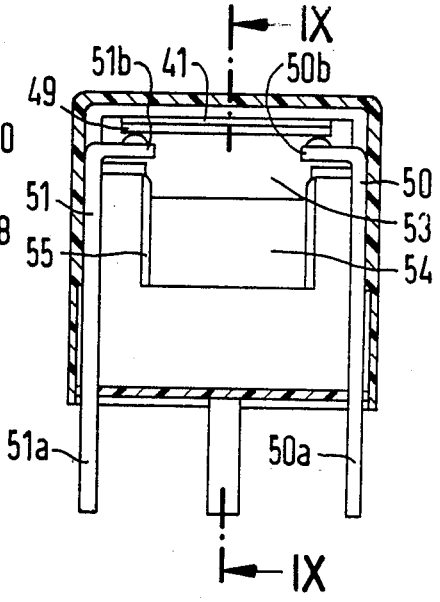

In FIGS. 9 through 11, a simple, compact or midget electrical contact relay is shown in which one of the above-described bridge contacts can be employed. The relay possesses a base member 31 which simultaneously serves as coil member for a winding 32. In the coil member a U-shaped core 33 is arranged whose two lateral legs 34 and 35 respectively lie adjacent spaced coil flanges 36 and 37. This core 33 can expediently be injected into the base member 31. Also, the coil can be extrusion-coated with plastic. On the core leg 34 an armature 38 is mounted which is disposed in plate-shaped fashion above the coil, parallel to the linear axis of the coil. The opposed free end of the armature 38, with its free end, forms a working movement air gap 39 with the core leg 35.

The armature 38 is supported in an insulating material part 40 which, for example, can be formed through extrusion coating of the armature. This insulating material part 40 could, however, also accommodate the armature through plugging-in or another type of mounting. Disposed above the insulating material part 40 is a bridge contact 41 which extends perpendicularly over the entire coil length and which is fixedly connected via the insulating part 40 with the armature 38. For mounting, for example, pins, bars, or other extensions can be provided on the insulating material member 40, which extensions, through heat deformation on the lateral edge or in recesses of the spring 41, retain the latter. The bridge contact 41, in the region of the coil flange 36, is downwardly bent at a right angle and thus forms a terminal lug 42 which is plugged through a recess 43 of the base member 31 and is anchored there with a tongue portion 44 bent off at an angle. A free leg 45 of the insulating material part 40, which leg is disposed in the region of the coil flange 36, serves as reset spring for the armature. The lower end of the leg 45 is supported via a nose tip 47 on a bent-out tongue 48 of the bridge contact 41.

The free end of the bridge contact 41 which, for example, can be designed to have a T-formation according to FIG. 1, bears a contact profile 49 which cooperates with two counter contact elements 50 and 51. These two counter contact elements, with their connection parts 50*a* and 51*a*, are respectively arranged laterally of the coil flange 37 and, with their contact making ends 50*b* and 51*b*, are bent in a common plane beneath the bridge contact spring 41. They are additionally insulated from the armature, and the core, through the leg 52 of the insulating material part 40. Through the lateral arrangement of the counter contact element a good heat transfer to ambient is provided. The coil flange 37 is formed, in the region between the two counter contact elements, with a chamber 53 for the accomodation of a getter tab 54 which is mounted between lamellar ribs 55 in the base member. These lamellae form additional insulating paths between the counter contacts which cannot be readily bridged even by melted or burn off products.

The relay is closed by a cap 56 of plastic which is placed in inverted position over the base member 31. The cap is sealed on the lower side with a fleece 57 which is saturated with synthetic resin. A rib 58 formed on the cap serves to limit the stroke of the armature, and the bridge contact spring 41. Moreover, the contact spring may be adjusted from above, for example, with laser beams, prior to application of the cap.

Figure 12:
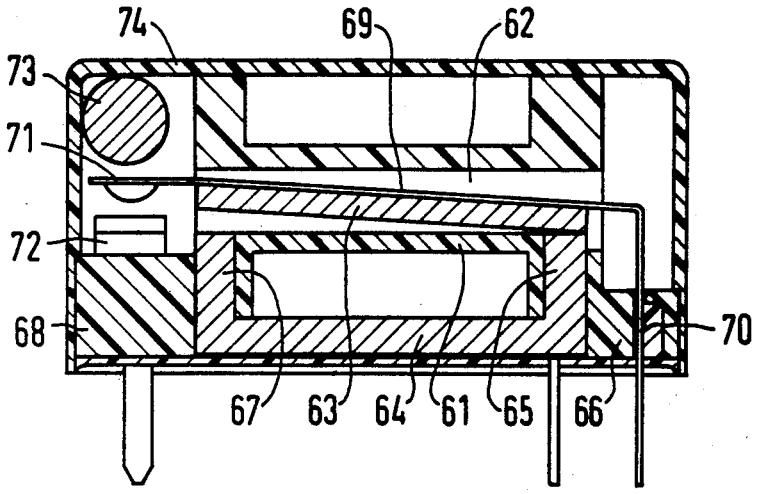
FIG. 12 shows an additional embodiment of a relay with a bridge contact according to the invention.

A further modified embodiment is shown in FIG. 12. In this case the coil member 61 forms a continuous axial cavity 62 in which a rod-shaped armature 63 is arranged. A U-shaped yoke 64 is inserted from below in recesses of the coil member 61 such that it forms a bearing point for the armature 63 with its leg 65 in the region of the coil flange 66, whereas the leg 67 in the region of the coil flange 68 forms a working air gap with the armature.

Connected with the armature 63 is a bridge contact spring 69 which, over the entire length of the coil tube, is disposed above the armature, and, with its leg 70, bent off at an angle, serving as terminal lug, is anchored in the coil flange 66. Through suitable pre-stress the bridge contact spring can simultaneously serve as a reset spring for the armature. The bridge contact spring may also be designed in T-formation also in this case, whereby the cross leg 71 is disposed at the end face before the coil winding in the region of the coil flange 68 and forms two contact points opposite two counter contact elements 72. The counter contact elements 72, like the counter contact elements 50 and 51, are laterally mounted on the coil flange and their contact making ends are bent off at an angle into a horizontal plane beneath the contact leg 71 of the bridge contact spring. Over the contact points a getter tab 73 is mounted in a suitable manner in the coil member. This relay is also closed with a cap 74.

Although various minor modifications may be suggested by those versed in the art, it should be understood that I wish to embody within the scope of the patent warranted hereon all such modifications as reasonably and properly come within the scope of my contribution to the art.

I claim as my invention:

1. An electrical relay assembly comprising an excitation coil means, an armature movable by operation of said excitation coil means, and a stationary counter contact means with two spaced-apart counter contact elements disposed in a plane, and a bridge contact means for controllably electrically bridging said counter contact elements in response to movement of said armature in one direction having a longitudinal first section fixed at one end of said armature and connected at the opposed end with a linearly directed second section, said second section having two contact points respectively disposed opposite said counter contact elements and offset from the longitudinal axis of said first section and said first section having a lateral width not greater than half the distance between said contact points such that said bridge contact means exhibits a first spring lever action along said first section and a second spring lever action along said second section when bridging said counter contact elements, wherein said second section is connected to said first section by an intermediate section laterally directed relative to said first section and the linear axis of said second section is substantially parallel to the longitudinal axis of said first section.

2. The electrical relay assembly of claim 1, wherein said second section is made up of two spaced-apart bodies disposed at opposed ends of said intermediate section.

3. An electrical relay assembly comprising an excitation coil means, an armature movable by operation of said excitation coil means, and a stationary counter contact means with two spaced-apart counter contact elements disposed in a plane, and a bridge contact means for controllably electrically bridging said counter contact elements in response to movement of said armature in one direction having a longitudinal first section fixed at one end to said armature and connected at the opposed end with a linearly directed second section, said second section having two contact points respectively disposed opposite said counter contact elements and offset from the longitudinal axis of said first section and said first section having a lateral width not greater than half the distance between said contact points such that said bridge contact means exhibits a first spring lever action along said first section and a second spring lever action along said second section when bridging said counter contact elements, wherein said first section is formed with laterally directed cut-out spaces therealong.

4. The electrical relay assembly of claim 3, wherein said two contact points are disposed on a single contact body extending along the linear length of said second section.

5. An electrical relay assembly comprising an excitation coil means, an armature movable by operation of said excitation coil means, and a stationary counter contact means with two spaced-apart counter contact elements disposed in a plane, and a bridge contact means for controllably electrically bridging said counter contact elements in response to movement of said armature in one direction having a longitudinal first section fixed at one end to said armature and connected at the opposed end with a linearly directed second section, said second section having two contact points respectively disposed opposite said counter contact elements and offset from the longitudinal axis of said first section and said first section having a lateral width not greater than half the distance between said contact points such that said bridge contact means exhibits a first spring lever action along said first section and a second spring lever action along said second section when bridging said counter contact elements, wherein said counter contact elements are disposed one above the other in said plane.

6. An electrical relay assembly comprising an excitation coil means, an armature movable by operation of said excitation coil means, and a stationary counter contact means with two spaced-apart counter contact elements disposed in a plane, and a bridge contact means for controllably electrically bridging said counter contact elements in response to movement of said armature in one direction having a longitudinal first section fixed at one end to said armature and connected at the opposed end with a linearly directed second section, said second section having two contact points respectively disposed opposite said counter contact elements and offset from the longitudinal axis of said first section and said first section having a lateral width not greater than half the distance between said contact points such that said bridge contact means exhibits a first spring lever action along said first section and a second spring lever action along said second section when bridging said counter contact elements, wherein said coil means and armature have parallel linear axes, said first section extending over said armature perpendicular to the linear axis of said armature extending from a terminal lug up one lateral side of said armature and across the top of said armature toward the opposite lateral side of said armature and said counter contact elements respectively extending up opposed front and back sides of said coil means perpendicular to the linear axis thereof and bending over in opposite directions above said coil means and apart from said opposite lateral side of said armature to terminate in portions directed parallel to the linear axis of said coil means.

7. The electrical relay assembly of claim 6, wherein said coil means has a U-shaped core with said armature being mounted on one free leg of said U and freely overlying the other free leg of said U.

8. The electrical relay assembly of claim 7, wherein an intermediate insulating piece overlies said armature, said first section resting on said insulating piece for connection with said armature.

9. The electrical relay assembly of claim 8, wherein said insulating piece is an embedding of said armature.

10. The electrical relay assembly of claim 8, wherein said insulating piece has a flexible leg portion extending down said one lateral side of said armature, parallel to said first section therealong, with a lower free end engaged against a relatively offset tongue portion of said first section, such that said leg portion acts as a reset spring for said armature.

11. The electrical relay assembly of claim 7, wherein a flange means extending about said other free leg of said U defines a chamber between and beneath said bent over portions of said counter contact elements, said chamber having sidewalls with lamellar projections and accomodating a getter means.

12. The electrical relay assembly of claim 6, wherein said armature is disposed intermediate of said coil means within an axial cavity defined by said coil means.

13. The electrical relay assembly of claim 6, further comprising a housing cover extending over said armature and formed with an interiorly directed stop portion for limiting movement of said armature and first section in the direction opposite said one direction.

* * * * *